US006201945B1

(12) United States Patent
Schlueter, Jr. et al.

(10) Patent No.: US 6,201,945 B1
(45) **Date of Patent: *Mar. 13, 2001**

(54) POLYIMIDE AND DOPED METAL OXIDE FUSER COMPONENTS

(75) Inventors: Edward L. Schlueter, Jr., Rochester; Joseph Mammino, Penfield; Gerald M. Fletcher, Pittsford; Donald S. Sypula, Penfield; James F. Smith, Ontario; Lucille M. Sharf, Pittsford; Robert M. Ferguson, Penfield, all of NY (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/004,554

(22) Filed: Jan. 8, 1998

(51) Int. Cl.[7] ..... G03G 15/20; G03G 15/14

(52) U.S. Cl. ..... 399/329; 399/307; 399/308; 399/313; 399/328; 428/195; 428/421; 428/422; 428/447; 428/451; 428/473.5; 430/98; 430/99; 430/126

(58) Field of Search ..... 399/307, 308, 399/313, 328, 329; 428/195, 156, 220, 473.5, 421, 422, 447, 451; 430/98, 99, 126

(56) References Cited

U.S. PATENT DOCUMENTS

| | | | | |
|---|---|---|---|---|
| 5,249,525 | | 10/1993 | Lewis et al. | 101/453 |
| 5,324,609 | | 6/1994 | Yagi et al. | 430/66 |
| 5,334,476 | | 8/1994 | Yagi et al. | 430/126 |
| 5,418,605 | | 5/1995 | Arahira et al. | 355/219 |
| 5,427,880 | | 6/1995 | Tamura et al. | 430/59 |
| 5,447,812 | | 9/1995 | Fukuda et al. | 430/66 |
| 5,503,955 | | 4/1996 | Snelling | 430/127 |
| 5,635,327 | | 6/1997 | Fukuda et al. | 430/128 |
| 5,922,440 | * | 7/1999 | Schlueter, Jr. et al. | 428/195 |

* cited by examiner

*Primary Examiner*—D. S. Nakarani
(74) *Attorney, Agent, or Firm*—Annette L. Bade

(57) ABSTRACT

A polyimide film component useful as fusing films and having electrically conductive doped metal oxide fillers dispersed therein, the fusing film having a surface resistivity of from about $10^4$ to about $10^{12}$ ohm/sq, and optionally provided on the polyimide film a conformable layer, or optionally in the following order, both a conformable intermediate layer and an outer release layer are provided on the polyimide film.

26 Claims, 3 Drawing Sheets

POLYIMIDE AND DOPED METAL OXIDE FUSER COMPONENTS

Attention is directed to copending application U.S. patent application Ser. No. 09/004,209, filed Jan. 8, 1998, entitled, "Haloelastomer and Doped Metal Oxide Compositions," U.S. patent application Ser. No. 09/004,421, filed Jan. 8, 1998, entitled, "Haloelastomer and Doped Metal Oxide Film Components," U.S. patent application Ser. No. 09/004,385, filed Jan. 8, 1998, entitled, "Polyimide and Doped Metal Oxide Intermediate Transfer Components," and U.S. patent application Ser. No. 09/004,492, filed Jan. 8, 1998, entitled, "Polyurethane and Doped Metal Oxide Film Components." The disclosures of each of these applications are hereby incorporated by reference in their entirety.

BACKGROUND OF THE INVENTION

The present invention relates generally to an imaging apparatus and film components thereof for use in electrostatographic, including digital, apparatuses. The film components herein are useful for many purposes including fixing a toner image to a copy substrate, and the like. More specifically, the present invention relates to film components comprising a high modulus polyimide which, in embodiments, is substantially filled with a conductive filler, preferably a doped metal oxide filler, in order to impart a desired resistivity. In specific embodiments, the conductive filler is an antimony doped tin oxide filler. In another embodiment, the film components comprise a polyimide substrate, and an outer layer provided thereon. In yet another embodiment, the film components comprise a polyimide substrate, an intermediate layer provided thereon, and an outer release layer provided on the intermediate layer. The films of the present invention may be useful as fuser members in xerographic machines, especially color machines.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused upon a support which may be the photosensitive member itself or other support sheet such as plain paper.

The use of thermal energy for fixing toner images onto a support member is well known and methods include providing the application of heat and pressure substantially concurrently by various means, a roll pair maintained in pressure contact, a belt member in pressure contact with a roll, a belt member in pressure contact with a heater, and the like. Heat may be applied by heating one or both of the rolls, plate members, or belt members. With a fixing apparatus using a thin film in pressure contact with a heater, the electric power consumption is small, and the warming-up period is significantly reduced or eliminated.

It is important in the fusing process that minimal or no offset of the toner particles from the support to the fuser member take place during normal operations. Toner particles offset onto the fuser member may subsequently transfer to other parts of the machine or onto the support in subsequent copying cycles, thus increasing the background or interfering with the material being copied there. The referred to "hot offset" occurs when the temperature of the toner is increased to a point where the toner particles liquefy and a splitting of the molten toner takes place during the fusing operation with a portion remaining on the fuser member. The hot offset temperature or degradation of the hot offset temperature is a measure of the release property of the fuser, and accordingly it is desired to provide a fusing surface which has a low surface energy to provide the necessary release. To ensure and maintain good release properties of the fuser, it has become customary to apply release agents to the fuser roll during the fusing operation. Typically, these materials are applied as thin films of, for example, silicone oils to prevent toner offset.

Another important method for reducing hot offset, is to impart antistatic and/or field assisted toner transfer properties to the fuser. However, to control the electrical conductivity of the release layer, the conformability and low surface energy properties of the release layer are often affected.

Attempts at controlling the conductivity of the outer layer of fuser members, particularly fuser belts or films, have been accomplished by, for example, adding conductive fillers such as ionic additives to the surface layer of the fuser member.

U.S. Pat. No. 5,411,779 to Nakajima et al. discloses a composite tubular article for a fusing belt comprising a tubular inner layer of polyimide and fluoroplastic outer layers.

U.S. Pat. No. 5,309,210 to Yamamoto discloses a belt apparatus comprising a base layer polyimide and a fluorine resin outer layer.

U.S. Pat. No. 5,149,941 to Hirabayashi and U.S. Pat. No. 5,196,675 to Suzuki disclose an image fixing apparatus comprising an electrically insulating material base layer and low resistance surface layer insulating member comprised of a polyimide.

U.S. Pat. No. 5,532,056 teaches a fixing belt comprised of a polyimide resin.

Attempts have been made to add electrically conductive additives to polymers in order to partially control the resistivity of the polymers. However, to some extent, there are problems associated with the use of these additives. In particular, undissolved particles frequently bloom or migrate to the surface of the polymer and cause an imperfection in the polymer. This leads to a nonuniform resistivity, which in turn, leads to poor antistatic properties and poor mechanical strength. The ionic additives on the surface may interfere with toner release and affect toner offset. The higher temperatures of the fusing process also increase the mobility of the ionic components and increase depletion rates. Furthermore, bubbles appear in the conductive polymer, some of which can only be seen with the aid of a microscope, others of which are large enough to be observed with the naked eye. These bubbles provide the same kind of difficulty as the undissolved particles in the polymer namely, poor or nonuniform electrical properties and poor mechanical properties.

In addition, the ionic additives themselves are sensitive to changes in temperature, humidity, operating time and applied field. These sensitivities often limit the resistivity range. For example, the resistivity usually decreases by up to two orders of magnitude or more as the humidity increases from 20% to 80% relative humidity. This effect limits the operational or process latitude.

Moreover, ion transfer can also occur in these systems. The transfer of ions will lead to contamination problems, which in turn, can reduce the life of the machine. Ion transfer also increases the resistivity of the polymer member after repetitive use. This can limit the process and operational latitude and eventually the ion-filled polymer component will be unusable.

Use of carbon black as a conductive filler has also been disclosed. Carbon black has been the chosen additive for imparting conductive properties in electrostatographic films. Carbon black is relatively inexpensive and very efficient in that a relatively small percentage can impart a high degree of conductivity. However, the blackness of this material makes it difficult and sometimes impossible to fabricate products with the desired level of conductivity. Further, films filled with carbon black have a tendency to slough and thereby contaminate their surroundings with black, conductive debris. In particular, the carbon black can cause undesirable black marks on the copied or printed substrates. Carbon black particles can also impart other specific adverse effects. Such carbon dispersions are difficult to prepare due to carbon agglomeration, and the resulting layers may deform due to random hard carbon agglomerate formation sites as well as non-uniform electrical properties. This can lead to an adverse change in the conformability of the fuser member, which in turn, can lead to insufficient fusing, poor release properties, hot offset, and contamination of other machine parts.

Generally, carbon additives tend to control the resistivities and provide somewhat stable resistivities upon changes in temperature, relative humidity, running time, and leaching out of contamination to photoconductors. However, the required tolerance in the filler loading to achieve the required range of resistivity has been extremely narrow. This, along with the large "batch to batch" variation, leads to the need for extremely tight resistivity control. In addition, carbon filled polymer surfaces have typically had very poor dielectric strength and sometimes significant resistivity dependence on applied fields. This leads to a compromise in the choice of centerline resistivity due to the variability in the electrical properties, which in turn, ultimately leads to a compromise in performance.

Many doped metal oxides offer significant advantages in both color and transparency when compared to carbon black. They are, however, relatively expensive and usually require higher dosages to achieve comparable levels of conductivity. In addition, dispersion of metal oxides can lead to short comings in surface roughness and particle size.

Therefore, a need remains for conductive fusing films for use in electrostatographic machines, wherein the film possesses the desired resistivity without the drawbacks of lack of transparency of the film which may adversely affect its use in color products, especially color imaging systems. Further, a need remains for a conductive film having conductive fillers which impart the desired resistivity without compromising surface roughness. Also, a need remains for films having improved mechanical properties to maintain film or belt integrity for improved flex life and image registration, improved electrical properties including a resistivity within the range desired for superior performance and a decrease in the occurrence of hot offset. Additionally, a need exists for controlling electrostatic transfer functions by neutralizing toner charges, improving chemical stability to liquid developer or toner additives, improving thermal stability for fusing operations, improving comformability, and providing low surface energy and higher modulus. Moreover, a need exists for a film in which the resistivity is uniform and is relatively unaffected by changes in environmental conditions such as changes in humidity, temperature, electrical surges, and the like. These and other needs are achievable with embodiments of the present invention.

SUMMARY OF THE INVENTION

The present invention provides, in embodiments, a fuser film component comprising a polyimide film containing electrically conductive doped metal oxide fillers dispersed therein, wherein the polyimide film has a preferred surface resistivity of from about $10^4$ to about $10^{12}$ ohm/sq.

The present invention further includes, in embodiments, a fuser film component comprising a polyimide film containing electrically conductive fillers of antimony doped tin oxide dispersed therein, wherein the polyimide film has a surface resistivity of from about $10^4$ to about $10^{12}$ ohm/sq, wherein there is provided an optional outer layer on the polyimide film or, in the alternative, an optional intermediate layer on the polyimide layer and an optional outer layer on the intermediate layer.

In addition, the present invention provides, in embodiments, an image forming apparatus for forming images on a recording medium comprising: a charge-retentive surface to receive an electrostatic latent image thereon; a development component to apply toner to said charge-retentive surface to develop an electrostatic latent image to form a developed image on said charge retentive surface; a transfer film component to transfer the developed image from said charge retentive surface to a copy substrate; and a fusing film component for fusing toner images to a surface of said copy substrate, said fusing film component comprising a polyimide film substrate, an optional intermediate conformable layer thereover, and an optional outer release layer on said intermediate layer, wherein said polyimide film comprises electrically conductive doped metal oxide fillers of antimony doped tin oxide dispersed therein, and wherein said polyimide film has a surface resistivity of from about $10^4$ to about $10^{12}$ ohm/sq.

BRIEF DESCRIPTION OF THE DRAWINGS

The above embodiments of the present invention will become apparent as the following description proceeds upon reference to the drawings which include the following figures.

DETAILED DESCRIPTION OF THE INVENTION

The present invention is directed to film components, and in particular, fusing components including fuser films, pressure films, donor films, and the like. In one embodiment of the present invention, the fuser film components comprise a substrate which comprises a polyimide having electrically conductive doped metal oxide fillers dispersed or contained therein. In another embodiment, the film components comprise a polyimide substrate having electrically conductive doped metal oxide fillers dispersed or contained therein, and an outer layer provided thereon. In a further embodiment, the fuser belt comprises a polyimide substrate having electrically conductive doped metal oxide fillers dispersed or contained therein, an intermediate layer provided thereon, and an outer release layer provided on the intermediate layer.

Figure 1:
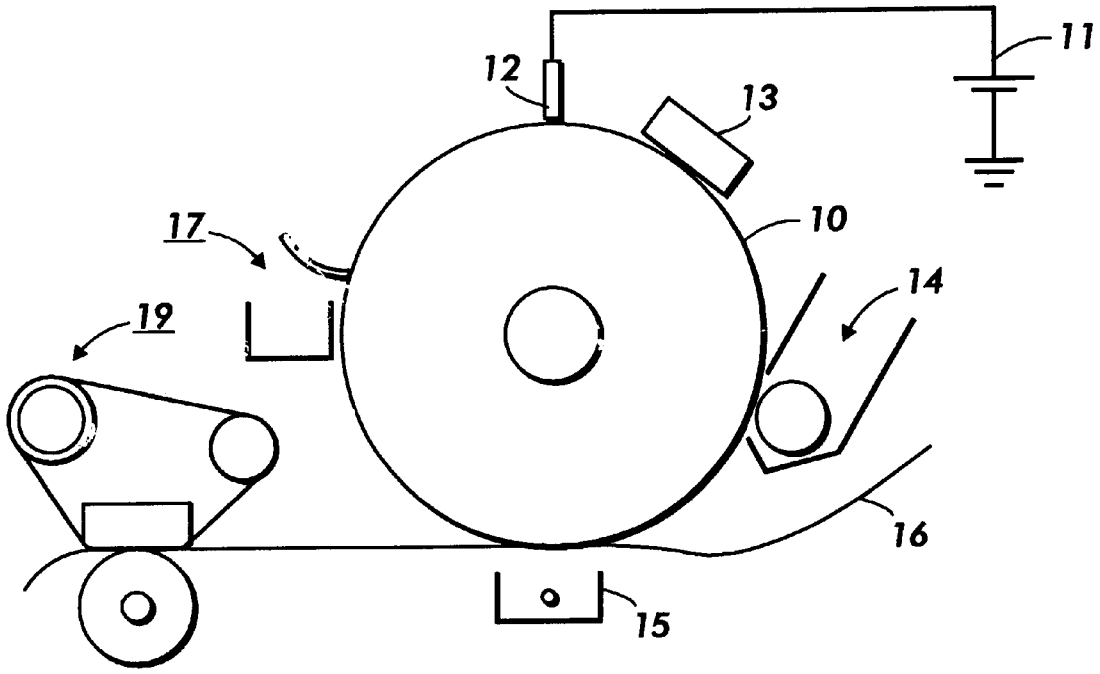
FIG. 1 is an illustration of a general electrostatographic apparatus.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon in image configuration.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing and pressure members, thereby forming a permanent image. Photoreceptor 10, subsequent to transfer, advances to cleaning station 17, wherein any toner left on photoreceptor 10 is cleaned therefrom by use of a blade (as shown in FIG. 1), brush, or other cleaning apparatus.

Figure 2:
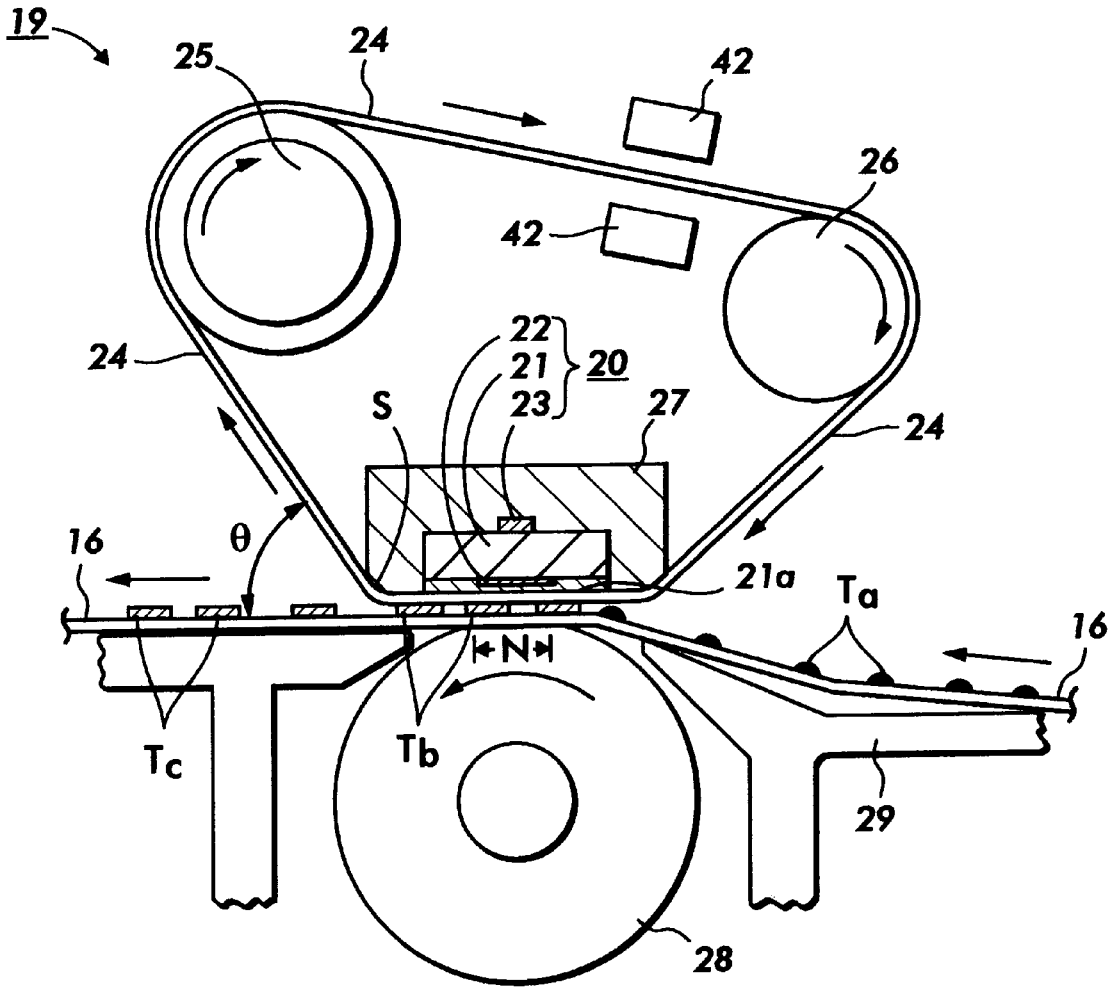
FIG. 2 is a sectional view of a heating apparatus in accordance with one embodiment of the present invention.

FIG. 2 shows a sectional view of an example of a fusing apparatus 19 according to an embodiment of the present invention. In FIG. 2, a heat resistive film or an image fixing film 24 in the form of an endless belt is trained or contained around three parallel members, that is, a driving roller 25, a follower roller 26 of metal and a low thermal capacity linear heater 20 disposed between the driving roller 25 and the follower roller 26.

The follower roller 26 also functions as a tension roller for the fixing film 24. The fixing film rotates at a predetermined peripheral speed in the clockwise direction by the clockwise rotation of the driving roller 25. The peripheral speed is the same as the conveying speed of the sheet having an image thereon so that the film is not creased, skewed or delayed.

A pressing roller 28 has a rubber elastic layer with parting properties, such as silicone rubber or the like, and is press-contacted to the heater 20 with the bottom travel of the fixing film 24 therebetween. The pressing roller is pressed against the heater at the total pressure of 4–7 kg by an urging means (not shown). The pressure roller rotates co-directionally, that is, in the counterclockwise direction, with the fixing film 24.

The heater 20 is in the form of a low thermal capacity linear heater extending in a direction crossing with the film 24 surface movement direction (film width direction). It comprises a heater base 27 having a high thermal conductivity, a heat generating resistor 22 generating heat upon electric power supply thereto, and a temperature sensor 23, and is mounted on a heater support 21 having high thermal conductivity.

The heater support 21 supports the heater 20 with thermal insulation on an image fixing apparatus and is made from high heat durability resin such as PPS (polyphenylene sulfide), PAI (polyamide imide), PI (polyimide), polyaramide, polyphthalamide, polyketones, PEEK (polyether ether ketone) or liquid crystal polymer material, or a compound material of such resin material and ceramics, metal, glass or the like material.

An example of the heater base 27 is in the form of an alumina plate having a thickness of 1.0 mm, a width of 10 mm and a length of 240 mm comprised of a high conductivity ceramic material.

The heat generating resistor material 22 is applied by screen printing or the like along a longitudinal line substantially at the center, of the bottom surface of the base 27. The heat generating material 22 is, for example, Ag/Pd (silver palladium), $Ta_2N$ or another electric resistor material having a thickness of approximately 10 microns and a width of 1–3 mm. It is coated with a heat resistive glass 21*a* in the thickness of approximately 10 microns, as a surface protective layer. A temperature sensor 23 is applied by screen printing or the like substantially at a center of a top surface of the base 27 (the side opposite from the side having the heat generating material 22). The sensor is made of Pt film having low thermal capacity. Another example of the temperature sensor is a low thermal capacity thermistor contacted to the base 27.

The linear or stripe heater 22 is connected with the power source at the longitudinal opposite ends, so that the heat is generated uniformly along the heater. The power source in this example provides AC 100 V, and the phase angle of the supplied electric power is controlled by a control circuit (not shown) in accordance with the temperature detected by the temperature detecting element 23.

A film position sensor 42 in the form of a photocoupler is disposed adjacent to a lateral end of the film 24. In response to the output of the sensor, the roller 26 is displaced by a driving means in the form of a solenoid (not shown), so as to maintain the film position within a predetermined lateral range.

Upon an image formation start signal, an unfixed toner image is formed on a recording material at the image forming station. The copy sheet 16 having an unfixed toner image Ta thereon is guided by a guide 29 to enter between the fixing film 24 and the pressing roller 28 at the nip N (fixing nip) provided by the heater 20 and the pressing roller 28. Copy sheet 16 passes through the nip between the heater 20 and the pressing roller 28 together with the fixing film 24 without surface deviation, crease or lateral shifting while the toner image carrying surface is in contact with the bottom surface with the fixing film 24 moving at the same speed as copy sheet 16. The heater 20 is supplied with electric power at a predetermined timing after generation of the image formation start signal so that the toner image is heated at the nip so as to be softened and fused into a softened or fused image Tb.

Fixing film 24 is sharply bent at an angle theta of, for example, about 45 degrees at an edge S (the radius of curvature is approximately 2 mm), that is, the edge having a large curvature in the heater support 21. Therefore, the sheet advanced together with the film 24 in the nip is separated by the curvature from the fixing film 24 at edge S. Copy sheet 16 is then discharged to the sheet discharging tray. By the time copy sheet 16 is discharged, the toner has sufficiently cooled and solidified and therefore is completely fixed (toner image Tc).

In this embodiment, heat generating element 22 and base 27 of heater 20 have low thermal capacity. In addition, heater element 22 is supported on support 21 through thermal insulation. The surface temperature of heater 20 in the nip quickly reaches a sufficiently high temperature which is necessary in order to fuser the toner. Also, a stand-by temperature control is used to increase the temperature of the heater 20 to a predetermined level. Therefore, power consumption can be reduced, and rise in temperature can be prevented.

The fixing film is in contact with the heater. The distance between the outer layer of the fixing film and the heater is preferably from about 0.5 mm to about 5.0 mm. Similarly, the distance between the fixing film and the grounded rollers 25 and 26 is not less than about 5 mm and is, for example, from about 5 to about 25 mm. These distances prevent leakage of the charge applied to the copy sheet 16 by an image (not shown) forming station from leaking to the ground through the copy sheet 16. Therefore, possible deterioration of image quality due to improper image transfer can be avoided, or minimized.

In another embodiment of the invention, not shown in the figures, the fixing film may be in the form of a sheet. For example, a non-endless film may be rolled on a supply shaft and taken out to be wrapped on a take-up shaft through the nip between the heater and the pressing roller. Thus, the film may be fed from the supply shaft to the take-up shaft at the speed which is equal to the speed of the transfer material, reference U.S. Pat. No. 5,157,446, the disclosure of which is hereby incorporated by reference in its entirety.

Figure 3:
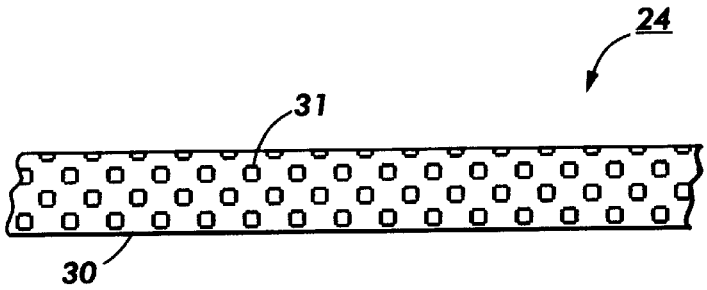
FIG. 3 is a schematic illustration of an embodiment of the present invention, and represents a fuser belt having a one layer configuration.

The fusing film of the present invention can be comprised of at least three different configurations. In one embodiment of the invention, the fusing film 24 is of a single layer configuration as shown in FIG. 3. Preferable, the single layer 30 is comprised of a polyimide filled with a conductive filler 31. The preferred conductive fillers are doped metal oxide fillers such as antimony doped tin oxide, antimony doped titanium dioxide, aluminum doped zinc oxide, similar doped metal oxides, and mixtures thereof.

The polyimide substrate of the film component herein is suitable for allowing a high operating temperature (i.e., greater than about 180, preferably greater than about 200° C. and more specifically, from about 200 to about 350° C.), capable of exhibiting high mechanical strength, providing heat conducting properties (this, in turn, improves the thermal efficiency of the proposed fusing system), and possessing tailored electrical properties.

The polyimide film substrate can be any suitable high tensile modulus polyimide capable of becoming a conductive film upon the addition of electrically conductive particles. A polyimide having a high tensile modulus is preferred primarily because the high tensile modulus optimizes the film stretch registration and transfer or fix conformance. The polyimide has the advantages of improved flex life and image registration, chemical stability to liquid developer or toner additives, thermal stability for transfix applications and for improved overcoating manufacturing, improved solvent resistance as compared to known materials used for film for transfer components, and improved electrical properties including a uniform resistivity within the desired range. Suitable polyimides include those formed from various diamines and dianhydrides, such as poly(amide-imide), polyetherimide, siloxane polyetherimide block copolymer such as, for example, SILTEM STM-1300 available from General Electric, Pittsfield, Mass., and the like. Preferred polyimides include aromatic polyimides such as those formed by the reacting pyromellitic acid and diaminodiphenylether sold under the tradename KAPTON®-type-HN available from DuPont. Another suitable polyimide available from DuPont and sold as KAPTON®-Type-FPC-E, is produced by imidization of copolymeric acids such as biphenyltetracarboxylic acid and pyromellitic acid with two aromatic diamines such as p-phenylenediamine and diaminodiphenylether. Another suitable polyimide includes pyromellitic dianhydride and benzophenone tetracarboxylic dianhydride copolymeric acids reacted with 2,2-bis[4-(8-aminophenoxy) phenoxy]-hexafluoropropane available as EYMYD type L-20N from Ethyl Corporation, Baton Rouge, La. Other suitable aromatic polyimides include those containing 1,2,1',2'-biphenyltetracarboximide and paraphenylene groups such as UPILEX®-S available from Uniglobe Kisco, Inc., White Plains, N.Y., and those having biphenyltetracarboximide functionality with diphenylether end spacer characterizations such as UPILEX®-R also available from Uniglobe Kisco, Inc. Mixtures of polyimides can also be used.

In a preferred embodiment, the polyimide is subjected to fluorine gas to produce a fluorinated polyimide film. This treatment reduces the surface energy, thereby improving the fusing ability and reducing the occurrence of hot offset.

The polyimide is present in the film in an amount of from about 60 to about 99.9 percent by weight of total solids, preferably from about 80 to about 90 percent by weight of total solids. Total solids as used herein includes the total percentage by weight of polymer, conductive fillers and any additives in the layer.

The film component of the present invention may be in the form of a nonconformable fusing component. In this case, the polyimide layer is the single layer or substrate layer as shown in FIG. 3 and has a thickness of from about 25 to about 150 $\mu$m thick, preferably from about 50 to about 100 $\mu$m thick, and particularly preferred from about 50 to about 75 $\mu$m thick. This non-conformable layer has a hardness of greater than about 80 Shore A, and preferably from about 80 to about 95 Shore A. The layer has an initial modulus of from about 300 PSI to about 1.5 M PSI. The electrical surface resistivity of this one layer film component is from about $10^4$ to about $10^{12}$ ohm/sq, preferably from about $10^6$ to about $10^{12}$ ohms/sq, and particularly preferred from about $10^8$ to about $10^{11}$ ohm/sq. The preferred volume resistivity is from about $10^4$ to about $10^{11}$, preferably from about $10^7$ to about $10^{11}$ ohm-cm. The tensile modulus of the film herein is preferably from about 300,000 to about 1,500,000 PSI and more preferably from about 500,000 to about 1,000,000 PSI. The tensile strength is, for example, from about 15,000 to about 57,000 PSI and preferably from about 25,000 to about 55,000 PSI. Further, the tensile elongation is preferably from about 5 to about 75%.

It is preferable that the polyimide used as the single layer herein have a smooth surface with roughness (Rz) of less than about 10 $\mu$m, preferably from about 0.5 to about 10 $\mu$m. Further, it is desirable that the polyimide layer have a surface energy of less than about 40, and preferably from about 20 to about 30 dynes/cm, or alternatively, be used with toners which contain a wax or long chain aliphatic hydrocarbon component which when melted function to prevent toner adhesion to the polyimide surface. In addition, it is desired that the polyimide layer be flexible enough to conform and bend to small radius turns yet maintain a flex life of greater than or equal to 2,000,000 cycles when tested around 25 mm diameter roller, with 2 lbs/in loads and speeds equal to or exceeding 20 in/sec.

The film herein, preferably in the form of a belt, has a width, for example, of from about 150 to about 2,000 mm, preferably from about 250 to about 1,400 mm, and particularly preferred is from about 300 to about 500 mm. The circumference of the belt is from about 75 to about 2,500 mm, preferably from about 125 to about 2,100 mm, and particularly preferred from about 155 to about 550 mm.

The one layer film member herein may be prepared by preparation of the polyimide, for example, by using the reaction product of a diamine with a dianhydride dissolved in a solvent such as N-methyl-2-pyrrolidone. An appropriate amount of filler is then added and dispersed therein in order to provide a surface resistivity of from about $10^4$ to about $10^{12}$, preferably from about $10^6$ to about $10^{12}$, and particularly preferred of from about $10^8$ to about $10^{11}$ ohms/sq. The filler is added and the mixture is pebble milled in a roller mill, attritor or sand mill. The poly(amic acid) filler mixture is cast onto a surface, the solvent removed by evaporation and heated to convert the poly(amic acid) to polyimide. After addition of the filler particles, the polyimide layer may be formed by extrusion into a sheet or into an endless loop by known methods. If not, the two ends of the member can be joined by heat or pressure and the resulting seam can be coated with an adhesive filler material and/or sanded to produce a seamless component by mechanical devices such as a pad or roller with single or multiple grades or abrasive surfaces, a skid plate, electronic laser ablation mechanism or chemical treatment as practiced in the art. In a preferred embodiment of the invention, the film is in the form of an endless seamed or seamless belt. The seam may impart a puzzle cut configuration as described above.

Figure 4:
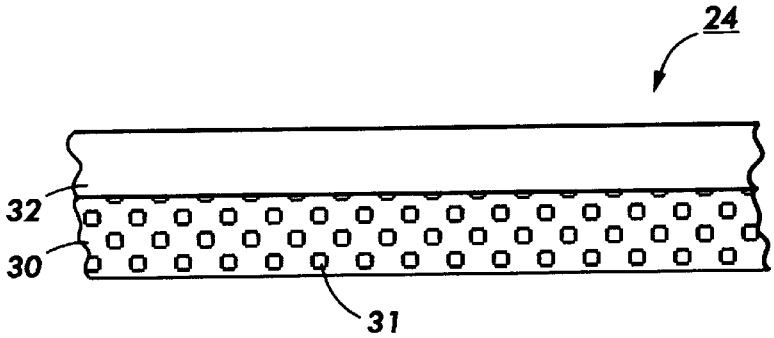
FIG. 4 is an illustration of an embodiment of the present invention, and represents a fuser belt having a two layer configuration.

In another embodiment of the invention, the fixing film 24 is of a two layer configuration as shown in FIG. 4. The fusing component may include the electrically conductive polyimide substrate as set forth above and thereover, an outer layer. In this embodiment, the substrate can be in the form of a beit, sleeve, tube or roll. The substrate imparts mechanical strength and the outer layer imparts conformability to a wide range of toner pile heights for superior fix. The outer layer can also be of a high hardness adequate to fix toner to smoother substrates or low volume xerographic devices.

In the two layer embodiment as depicted in FIG. 4, the fusing film 24 comprises a substrate 30, and having thereon an outer layer 32. In the two layer configuration, the substrate 30 is preferably comprised of a polyimide filled with a conductive filler 31. Preferably, the filler is a doped metal oxide filler such as aluminum doped zinc oxide (ZnO), antimony doped titanium dioxide ($TiO_3$), antimony doped tin oxide, similar doped oxides, and mixtures thereof. The outer layer 32 is provided on the polyimide substrate 30. Preferably the outer layer 32 is comprised of low surface energy (of for example, in embodiments, from about 20 to about 30 dynes/cm), and high temperature resistant materials such as silicone rubbers, fluoropolymers, urethanes, acrylic, titamers, ceramers, and hydrofluoroelastomers such as volume grafted fluoroelastomers.

Preferred materials for the outer layer 32 include fluoroelastomers such as copolymers and terpolymers of vinylidenefluoride, hexafluoropropylene and tetrafluoroethylene, which are known commercially under various designations as VITON A®, VITON E®, VITON E60®, VITON E45®, VITON E430®, VITON 910®, VITON GH®, VITON B50®, and VITON GF®. The VITON® designation is a Trademark of E.l. DuPont de Nemours, Inc. Other commercially available materials include FLUOREL 2170®, FLUOREL 2174®, FLUOREL 2176®, FLUOREL 2177® and FLUOREL LVS 76® FLUOREL® being a Trademark of 3M Company. Additional commercially available materials include AFLAS$^{m}$ a poly(propylene-tetrafluoroethylene) and FLUOREL II® (LII900) a poly(propylene-tetrafluoroethylenevinylidenefluoride) both also available from 3M Company, as well as the Tecnoflons identified as FOR-60KIR®, FOR-LHF®, NM® FOR-THF®, FOR-TFS®, TH®, TN505® available from Montedison Specialty Chemical Company.

Two preferred known fluoroelastomers are (1) a class of copolymers of vinylidenefluoride, tetrafluoroethylene and hexafluoropropylene known commercially as VITON A® and (2) a class of terpolymers of vinylidenefluoride, hexafluoropropylene, and tetrafluoroethylene known commercially as VITON B®. VITON A®, and VITON B®, and other VITON® designations are trademarks of E.l. DuPont de Nemours and Company.

In another preferred embodiment, the fluoroelastomer is a tetrapolymer having a relatively low quantity of vinylidenefluoride. An example is VITON GF®, available from E.l. DuPont de Nemours, Inc. The VITON GF® has 35 mole percent of vinylidenefluoride, 34 mole percent of hexafluoropropylene and 29 mole percent of tetrafluoroethylene with 2 percent cure site monomer. The cure site monomer can be those available from DuPont such as 4-bromoperfluorobutene-1,1,1-dihydro-4-bromoperfluorobutene-1,3-bromoperfluoropropene-1,1,1-dihydro-3-bromoperfluoropropene-1, or any other suitable, known, commercially available cure site monomer.

In another embodiment of the invention, the fluoroelastomer is a volume grafted elastomer. Volume grafted elastomers are a special form of hydrofluoroelastomer and are substantially uniform integral interpenetrating networks of a hybrid composition of a fluoroelastomer and a polyorganosiloxane, the volume graft having been formed by dehydrofluorination of fluoroelastomer by a nucleophilic dehydrofluorinating agent, followed by addition polymerization by the addition of an alkene or alkyne functionally terminated polyorganosiloxane and a polymerization initiator.

Volume graft, in embodiments, refers to a substantially uniform integral interpenetrating network of a hybrid composition, wherein both the structure and the composition of the fluoroelastomer and polyorganosiloxane are substantially uniform when taken through different slices of the fuser member. A volume grafted elastomer is a hybrid composition of fluoroelastomer and polyorganosiloxane formed by dehydrofluorination of fluoroelastomer by nucleophilic dehydrofluorinating agent followed by addition polymerization by the addition of alkene or alkyne functionally terminated polyorganosiloxane. Examples of specific volume graft elastomers are disclosed in U.S. Pat. No. 5,166,031; U.S. Pat. No. 5,281,506; U.S. Pat. No. 5,366,772; and U.S. Pat. No. 5,370,931, the disclosures of which are herein incorporated by reference in their entirety.

Other preferred polymers useful as the outer layer in the two layer configuration include silicone rubbers and preferably silicone rubbers having molecular weights of from about 600 to about 4,000, such as silicone rubber 552, available from Sampson Coatings, Richmond, Va., (polydimethyl siloxane/dibutyl tin diacetate, 0.45 g DBTDA per 100 grams polydimethyl siloxane rubber mixture, with molecular weight of approximately 3,500). Additional polymers useful as the outer layer include fluorosilicones, along with fluoropolymers such as polytetrafluoroethylene (PTFE), fluorinated ethylenepropylene copolymer (FEP), polyfluoroalkoxypolytetrafluoroethylene (PFA Teflon) and the like. These polymers, together with adhesives, can also be included as intermediate layers.

The polyimide layer of the two layer configuration has the properties as described above for the one layer configuration.

The outer layer of the two-layer configuration can be either soft or hard. The hardness of a hard outer layer is from about 1,000 to about 1.5 million PSI, and preferably from about 300,000 to about 1.0 million PSI. The hardness of a soft outer layer is preferably from about 300 to about 1,000 PSI, and preferably from about 500 to about 800 PSI. The outer layer of the two layer configuration has a thickness of from about 25 to about 5000 $\mu$m, and a preferred thickness of from about of 25 to about 500 $\mu$m. The preferred resistivity is from about $10^4$ to about $10^{12}$, preferably from about $10^6$ to about $10^{12}$, and particularly preferred from about $10^8$ to about $10^{11}$ ohm/sq. The preferred surface energy is less than about 40, and preferably from about 20 to about 30 dynes/cm. The polymer comprising the outer layer is preferably present in the outer layer in an amount of from about 60 to about 99.9 percent., and preferably from about 80 to about 90 percent by weight of total solids.

The outer layer is coated on the substrate in any suitable known manner. Typical techniques for coating such materials on the reinforcing member include liquid and dry powder spray coating, dip coating, wire wound rod coating, fluidized bed coating, powder coating, electrostatic spraying, sonic spraying, blade coating and the like. It is preferred to spray or flow coat the outer material.

Figure 5:
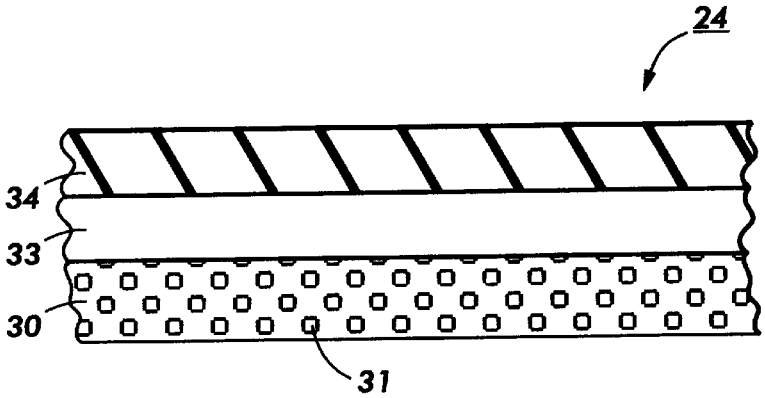
FIG. 5 is an illustration of an embodiment of the present invention, and represents a fuser belt having a three layer configuration.

In a third embodiment as depicted in FIG. 5, the fuser film 24 is of a three layer configuration and comprises a substrate 30 having an electrically conductive filler 31 dispersed therein, an intermediate layer 33 (preferably a conformable layer) and an outer layer release layer 34 provided on the intermediate layer 33. Preferably, the intermediate layer 33 comprises a fluoroelastomer, examples and properties of which have already been disclosed above, and the outer layer 34 is comprised preferably of a silicone rubber, examples and properties of which are set forth above. This three layer configuration provides superior conformability and is suitable for use in color xerographic machines.

In the three layer configuration, the substrate polyimide layer has the properties as described above. The intermediate layer is preferably a conformable layer. The intermediate layer has a surface energy of from about 20 to about 60 and preferably from about 30 to about 50 dynes/cm. The thickness of the intermediate layer is from about 25 to about 5,000, and preferably from about 25 to about 500 micrometers. Both the outer layer and the intermediate layer have a hardness of from about 25 to about 80 Shore A, preferably from about 40 to about 60 Shore A. The outer layer is a relatively thin layer having a thickness of from about 5 to about 75, and preferably from about 10 to about 25 micrometers. The outer layer has a surface energy of less than about 40, and preferably from about 20 to about 30 dynes/cm.

The outer layer in the two layer configuration and the outer layer in the three layer configuration have the same surface resistivity as that of the polyimide layer in the one layer configuration. Further, the polymers of the intermediate and outer layers are preferably present in the respective layers in an amount of from about 60 to about 99.9 percent, and preferably from about 80 to about 90 percent by weight of total solids.

The film component employed for the present invention can be of any suitable configuration. Examples of suitable configurations include a sheet, a film, a web, a foil, a strip, a coil, a cylinder, a drum, an endless strip, a circular disc, a belt including an endless belt, an endless seamed flexible belt, an endless seamless flexible belt, an endless belt having a puzzle cut seam, and the like. It is preferred that the substrate be an endless seamed flexible belt or seamed flexible belt, which may or may not include puzzle cut seams. Examples of such belts are described in U.S. Pat. Nos. 5,487,707; 5,514,436; and U.S. patent application Ser. No. 08/297,203 filed Aug. 29, 1994, the disclosures each of which are incorporated herein by reference in their entirety. A method for manufacturing reinforced seamless belts is set forth in U.S. Pat. No. 5,409,557, the disclosure of which is hereby incorporated by reference in its entirety.

The fuser film includes electrically conductive particles dispersed therein. These electrical conductive particles decrease the base material resistivity into the desired surface resistivity range of, for example, from about $10^4$ to about $10^{12}$, preferably from about $10^6$ to about $10^{12}$, and more preferably from about $10^8$ to about $10^{11}$ ohms/sq. The desired resistivity can be provided by varying the concentration of the conductive filler. It is important to have the resistivity within this desired range. The film component will exhibit undesirable effects if the resistivity is not within the required range, including nonconformance at the contact nip, poor toner releasing properties resulting in hot offset and copy contamination, and generation of contaminant during charging. Other problems include resistivity that is susceptible to changes in temperature, relative humidity, running time, and leaching out of contamination to photoconductors. The control of conductivity in the fuser belt can minimize paper and debris contamination. The resistivity can also assist in applying a field to assist in releasing the toner and paper from the fusing event. The thermal conductivity of the material is important if you are heating through the belt to the paper and toner.

Preferably, a doped metal oxide is contained or dispersed in the polyimide layer. Preferred doped metal oxides include antimony doped tin oxide, aluminum doped zinc oxide, similar doped metal oxides, and mixtures thereof. Other conductive fillers can be added to the polyimide layer. Examples of additional conductive fillers include carbon blacks and graphite; and metal oxides such as tin oxide, antimony dioxide, titanium dioxide, indium oxide, zinc oxide, indium oxide, indium tin trioxide, and the like; and mixtures thereof. The additional filler (i.e., fillers other than doped metal oxide fillers) may be present in an amount of from about 1 to about 40 and preferably from about 4 to about 20 parts by weight of total solids.

In a preferred embodiment of the invention, the electrically conductive filler is antimony doped tin oxide. Suitable antimony doped tin oxides include those antimony doped tin oxides coated on an inert core particle (e.g., ZELEC® ECP-S, M and T) and those antimony doped tin oxides without a core particle (e.g., ZELEC® ECP-3005-XC and ZELEC® ECP-3010-XC). ZELEC® is a trademark of DuPont Chemicals Jackson Laboratories, Deepwater, N.J.

The core particle may be mica, $TiO_2$ or acicular particles having a hollow or a solid core.

In a preferred embodiment, the antimony doped tin oxides are prepared by densely layering a thin layer of antimony doped tin oxide onto the surface of a silica shell or silica-based particle, wherein the shell, in turn, has been deposited onto a core particle. The crystallites of the conductor are dispersed in such a fashion so as to form a dense conductive surface on the silica layer. This provides optimal conductivity. Also, the outer particles are fine enough in size to provide adequate transparency. The silica may either be a hollow shell or layered on the surface of an inert core, forming a solid structure.

Preferred forms of antimony doped tin oxide are commercially available under the tradename ZELEC® ECP (electroconductive powders) from DuPont Chemicals Jackson Laboratories, Deepwater, N.J. Particularly preferred antimony doped tin oxides are ZELEC® ECP 1610-S, ZELEC® ECP 2610-S, ZELEC® ECP 3610-S, ZELEC® ECP 1703-S, ZELEC® ECP 2703-S, ZELEC® ECP 1410-M, ZELEC® ECP 3005-XC, ZELEC® ECP 3010-XC, ZELEC® ECP 1410-T, ZELEC® ECP 3410-T, ZELEC® ECP-S-X1, and the like. Three commercial grades of ZELEC® ECP powders are preferred and include an acicular, grades of shell product (ZELEC® ECP-S), an equiaxial titanium dioxide core product (ZELEC ECP-T), and a plate shaped mica core product (ZELEC® ECP-M). The following Tables demonstrate the product properties of ZELEC® ECP. This information was taken from a DuPont Chemicals Jackson Laboratories product brochure, dated September, 1992 and entitled, "The Application of Zelec ECP in Static Dissipative Systems."

TABLE 1

Product Physical Properties (S, T & M)

| Property | Core | Shape | Mean Part. Size |
|---|---|---|---|
| ECP-S | Hollow | Acicular | 3 microns |
| ECP-T | Solid | Equiaxial | 1 micron |
| ECP-M | Solid | Platelike | 10 microns |

TABLE 2

Product Chemical Properties (S, T & M)

| Property | ECP-S | ECP-T | ECP-M |
|---|---|---|---|
| Bulk Density | 0.4 gm/cc | 1.0 gm/cc | 0.6 gm/cc |
| Specific gravity | 3.9 gm/cc | 4.9 gm/cc | 3.9 gm/cc |
| Surface area | 50 $m^2$/gm | 20 $m^2$/gm | 30 $m^2$/gm |
| Mean part. size | 3 microns | 1 micron | 10 micron |
| Dry powder resist | 2–30 ohm-cm | 2–30 ohm-cm | 20–300 ohm-cm |
| Core | Hollow | $TiO_2$ | Mica |

TABLE 3

Product Properties (XC)

| Property | 3005-XC | 3010-XC |
|---|---|---|
| Antimony % | 6.5 | 10 |
| Bulk powder resist. | .5 to 3 ohm-cm | .5 to 3 ohm-cm |
| Specific gravity | 6.5 to 7.5 gm/cc | 6.5 to 7.5 gm/cc |
| Surface area | 15 to 30 $m^2$/gm | 60 to 80 $m^2$/gm |
| Particle size (D50) | .7 microns | 2 microns |

In a particularly preferred embodiment of the invention, antimony doped tin oxide is added to the polyimide layer in an amount of about 5 to about 65 percent by weight of total solids, preferably from about 10 to about 50 percent by weight of total solids, and particularly preferred of from about 10 to about 30 percent by weight of total solids. Total solids is defined as the amount of polymer, filler(s), and any additives.

Optionally, any known and available suitable adhesive layer may be positioned between the polyimide substrate and the outer conformable layer in the two layer configuration. An adhesive may be positioned between the polyimide substrate and the intermediate conformable layer and/or between the conformable layer and the release layer in the three layer configuration. Examples of suitable adhesives include Dow Corning® A 4040 prime coat, which is especially effective when used with fluorosilicone layers, and Dow Tactix® blends, Ciba-Geigy Araldite® MY-721 and Morton Thixon 330/311, all of which are suitable for use with fluoropolymer and silicone rubber layers. The adhesive may have the same electrical properties as the substrate, polyimide or intermediate conformable layer.

Additives may be present in any of the above described layers.

Specific embodiments of the invention will now be described in detail. These examples are intended to be illustrative, and the invention is not limited to the materials, conditions, or process parameters set forth in these embodiments. All parts are percentages by solid weight unless otherwise indicated.

EXAMPLES

Example 1

Single Layer Fuser Material

A single layer resistive polyimide fuser material having an antimony doped tin oxide filler dispersed therein were prepared. An antimony doped tin oxide filler having the tradename ZELEC® 3005-xc available from DuPont Chemicals Jackson Laboratories, Deepwater, N.J., was mixed with a polyimide monomer (KAPTON® MT, available from DuPont) and the mixture was milled to form a homogeneous dispersion. The homogeneous dispersion can be purchased from DuPont as DuPont designation 300PB. The resulting dispersion was coated by extrusion onto a drum and the polyimide monomers were allowed to crosslink into a thin film of from about 25 to about 150 microns thick. The properties of the fuser material were measured using known methods. The material had a modulus of 500K PSI, a volume resistivity of approximately $1\times10^{10}$ ohm/sq, and a surface energy of about 37 dynes/cm before fluorination. The fuser material was flexed around 25 mm rollers with a 2 lb/in load at a speed of 20 inches/second. The material was shown to exhibit a flex life of more than about 2,000,000 imaging cycles before testing was suspended. The surface quality of the fuser material was determined to be smooth and free of undesirable dimples and flaws which are common with carbon black filled materials.

The material was formed into a seamed belt using a puzzle cut seam pattern with an adhesive. No appearance of markings on the paper due to film filler offsetting or coining was demonstrated. These markings are common with carbon black or graphite filled films. The surface of the film was exposed to fluorine gas to produce a fluorinated polyimide film surface. The surface energy was reduced to 28 dynes/cm. Initial toner release from the film was complete. It was determined that this material can be used for smooth substrates and low density toner images.

Example 2

Two Layer Fuser Material

A polyimide fuser material was prepared in accordance with Example 1 with no surface fluorination. The polyimide material was coated with a Dow Corning A 4040 primer adhesive and subsequently overcoated by a reverse roll coating method with 552 (100 parts hydroxy polydimethyl siloxane with molecular weight of approximately 3500, 15 parts ethyl silicate/ethyl alcohol, 60 parts iron oxide, 60 parts MEK, and 1 part dibutyl tin diacetate) silicone material. Other samples of the polyimide material were coated with a fluoroelastomer (such as those available from DuPont under the tradename VITON®), urethane, fluorosilicone and silicone rubber. After coating, the coatings were then cured through an air tunnel through a ramped temperature up to about 250° C. for about 24 hours depending on the outer elastomer coating material. The coatings were measured to have a thickness of about 55 to about 125 microns.

The polyimide/Zelec® material coated with silicone rubber 522 demonstrated an initial modulus of 300 PSI, a resistivity of about $10^{14}$ ohms/sq and a surface energy of from about 21 to about 26 dynes/cm.

A fuser belt was formed by puzzle cut seaming with an adhesive. Some belts were also puzzle cut and then tape seamed to facilitate functional testing. The fluoroelastomer (e.g., VITON® GF) and 522 coated belts were tested for toner release through thousands of fuser test cycles with the silicone 522 demonstrating improved release and overall life stability with dry toner, and the VITON® GF demonstrating excellent thermal stability.

The two layer belt system enables toner conformability with either liquid or dry toner to rough substrates when outer layer thickness approached 75 $\mu$m.

Example 3

Three Layer Fuser System

A three layer fuser belt was fabricated using the polyimide/ZELEC® material as prepared in Example 1. A conformable VITON® E45 material (purchased from DuPont) was fabricated over the polyimide/ZELEC® to a thickness of about 75 $\mu$m. This material had electrical properties equivalent to the base material and conformability to conform to rough papers. A silicone elastomer known as 552 (polydimethyl siloxane with molecular weight of approximately 3500 and filled with iron oxide) release layer was then overcoated to a thickness of approximately 25 $\mu$m.

The three layer system demonstrated a resistivity of $10^{10}$ ohms/sq and an initial modulus of 500 PSI.

Optimum release and electrical properties were demonstrated using the three layer material.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. An apparatus comprising (a) a fuser film comprising a polyimide film and at least one electrically conductive doped metal oxide filler dispersed therein, wherein said polyimide film has a surface resistivity of from about $10^4$ to about $10^{12}$ ohms/sq, and (b) a heat source associated with said fuser film for heating said fuser film.

2. The apparatus of claim 1, wherein said electrically conductive doped metal oxide filler is an antimony doped tin oxide filler.

3. The apparatus of claim 1, wherein said electrically conductive filler is present in an amount of from about 5 to about 65 percent by weight of total solids.

4. The apparatus of claim 1, wherein said polyimide is selected from the group consisting of aromatic polyimides, poly(amide-imide), polyetherimide, siloxane polyetherimide block copolymers and mixtures thereof.

5. The apparatus of claim 4, wherein said polyimide is an aromatic polyimide selected from the group consisting of a) the reaction product of pyromellitic acid and diaminodiphenylether, b) the imidization product of a copolymeric acid of biphenyltetracarboxylic acid and pyromellitic acid with phenylenediamine and diaminodiphenylether, c) the reaction product of pyromellitic dianhydride and benzophenone tetracarboxylic dianhydride copolymeric acids with 2,2-bis[4-(8-aminophenoxy) phenoxy]-hexafluoropropane, d) polyimides comprising 1,2, 1',2'-biphenyltetracarboximide and para-phenylene groups, and e) polyimides comprising biphenyltetracarboximide functionality with diphenylether end spacers.

6. The apparatus of claim 1, wherein said polyimide is fluorinated.

7. The apparatus of claim 1, wherein said polyimide film is a non-conformable film having an initial modulus of from about 300 to about 1.5 million PSI.

8. The apparatus of claim 1, wherein said fuser film further comprising an outer layer provided on said polyimide film.

9. The apparatus of claim 8, wherein said outer layer comprises a material selected from the group consisting of fluoropolymers and silicone rubbers.

10. The apparatus of claim 9, wherein said outer layer comprises a fluoropolymer selected from the group consisting of polyfluoroalkoxypolytetrafluoroethylene, polytetrafluoroethylene, and fluorinated ethylenepropylene copolymer.

11. The apparatus of claim 9, wherein said outer layer comprises a fluorosilicone rubber.

12. The apparatus of claim 9, wherein said outer layer comprises a fluoroelastomer selected from the group consisting of a) copolymers of vinylidenefluoride, hexafluoropropylene and tetrafluoroethylene, b) terpolymers of vinylidenefluoride, hexafluoropropylene and tetrafluoroethylene, and c) tetrapolymers of vinylidenefluoride, hexafluoropropylene, tetrafluoroethylene and a cure site monomer.

13. The apparatus of claim 8, wherein said outer layer is a hard outer layer having an initial modulus of from about 1,000 to about 1.5 million PSI.

14. The apparatus of claim 8, wherein said outer layer is a soft outer layer having an initial modulus of from about 300 to about 1,000 PSI.

15. The apparatus of claim 8, wherein the outer layer has a surface energy of from about 20 to about 30 dynes/cm.

16. The apparatus of claim 1, wherein said fuser film further comprising an intermediate layer on said polyimide film, and a release layer provided on said intermediate layer.

17. The apparatus of claim 16, wherein said intermediate layer comprises a fluoropolymer selected from the group consisting of a) copolymers of vinylidenefluoride, hexafluoropropylene and tetrafluoroethylene, b) terpolymers of vinylidenefluoride, hexafluoropropylene and tetrafluoroethylene, and c) tetrapolymers of vinylidenefluoride, hexafluoropropylene, tetrafluoroethylene and a cure site monomer.

18. The apparatus of claim 16, wherein said release layer comprises a silicone rubber.

19. The apparatus of claim 16, wherein said outer release layer further comprises a conductive filler selected from the group consisting of carbon black, boron nitride and metal oxides.

20. The apparatus of claim 19, wherein said metal oxide conductive filler is iron oxide.

21. The apparatus of claim 1, wherein said surface resistivity is from about $10^8$ to about $10^{11}$ ohm/sq.

22. The apparatus of claim 1, wherein said heat source is in contact with said fuser film.

23. An aoparatus comprising (a) a fuser film component comprising a polyimide film containing electrically conductive fillers of antimony doped tin oxide dispersed therein, wherein the polyimide film has a surface resistivity of from about $10^4$ to about $10^{12}$ ohm/sq, wherein there is provided an optional intermediate layer on the polyimide film, and an optional outer release layer on the intermediate layer, and (b) a heat source associated with said fuser film for heating said fuser film component.

24. The apparatus of claim 23, wherein said heat source is in contact with said fuser film component.

25. An image forming apparatus for forming images on a recording medium comprising:

a charge-retentive surface to receive an electrostatic latent image thereon;

a development component to apply toner to said charge-retentive surface to develop an electrostatic latent image to form a developed image on said charge retentive surface;

a transfer film component to transfer the developed image from said charge retentive surface to a copy substrate;

a fusing film component for fusing toner images to a surface of said copy substrate, said fusing film component comprising a polyimide film substrate, an optional intermediate conformable layer thereover, and an optional outer release layer on said intermediate layer, wherein said polyimide film comprises electrically conductive doped metal oxide fillers dispersed therein, and wherein said polyimide film has a surface resistivity of from about $10^4$ to about $10^{12}$ ohm/sq; and a heat source associated with said fuser film for heating said fusing film component such that said toner images are fused to said copy substrate.

26. The apparatus of claim 25, wherein said heat source is in contact with said fusing film component.

* * * * *